US007090200B2

(12) United States Patent
Morse et al.

(10) Patent No.: US 7,090,200 B2
(45) Date of Patent: Aug. 15, 2006

(54) ACTUATOR

(76) Inventors: Christopher J. Morse, 130 Glen St., Malden, MA (US) 02148; Benjamin T. Krupp, 1216 W. Waveland Ave., Chicago, IL (US) 60613; Jerry E. Pratt, 1131 E. Blount St., Pensacola, FL (US) 32503; Aaron G. Flores, 1079 Bluewood Ter., Weston, FL (US) 33327

( * ) Notice: Subject to any disclaimer, the term of this patent is extended or adjusted under 35 U.S.C. 154(b) by 141 days.

(21) Appl. No.: 10/304,525

(22) Filed: Nov. 26, 2002

(65) Prior Publication Data

US 2003/0127635 A1 Jul. 10, 2003

Related U.S. Application Data

(60) Provisional application No. 60/333,610, filed on Nov. 27, 2001.

(51) Int. Cl.
*B66D 1/00* (2006.01)

(52) U.S. Cl. ..... 254/332; 254/362; 254/272

(58) Field of Classification Search ..... 254/362, 254/270, 272, 273, 274, 275, 277, 332, 329
See application file for complete search history.

(56) References Cited

U.S. PATENT DOCUMENTS 2,434,138 A * 1/1948 Adams ..... 177/48
2,689,890 A * 9/1954 Green ..... 200/61.13
3,921,959 A 11/1975 Ulbing
3,940,110 A 2/1976 Motoda
4,491,301 A * 1/1985 Pendola ..... 254/285
4,530,245 A * 7/1985 Jacobson ..... 73/768
4,624,450 A * 11/1986 Christison ..... 254/273
4,921,293 A 5/1990 Ruoff et al.
5,295,664 A * 3/1994 Kamper ..... 254/220
5,327,790 A 7/1994 Levin et al.
5,650,704 A 7/1997 Pratt et al.
5,662,311 A * 9/1997 Waedekin et al. ..... 254/273
5,865,426 A 2/1999 Kazerooni
5,929,587 A 7/1999 Kang
6,022,002 A * 2/2000 Niggli ..... 254/273
6,241,462 B1 6/2001 Wannasuphoprasit et al.

(Continued)

FOREIGN PATENT DOCUMENTS

DE 003832000 A1 * 4/1989

(Continued)

*Primary Examiner*—Kathy Matecki
*Assistant Examiner*—Evan Langdon

(57) ABSTRACT

An actuator and control algorithm which provide an operator with the ability to intuitively and responsively maneuver heavy work-pieces with ease and precision. The structure of the apparatus may provide a hoist with a compliant sensing system to measure the weight of the payload. The compliant sensing system may result in smaller dead-bands than are realizable with traditional force sensing methods. At the command of the user, the control algorithm may switch between two distinct operational modes: float mode and manual mode. In float mode, the hoist actively counterbalances the weight of the load, allowing it to feel substantially weightless in the operator's hands. The operator can apply forces directly to the payload to accelerate it in the desired vertical direction. Because of the small dead-band realized with compliant sensing, the payload may be highly responsive to the operators force inputs. As a result, the payload may be intuitively maneuvered at very high speeds, as well as very low speeds. Alternately, the operator may choose to operate in manual mode. While in manual mode, the hoist operates like traditional lifting hoists, responding to velocity commands issued from a remotely controlled pendant.

2 Claims, 8 Drawing Sheets

U.S. PATENT DOCUMENTS

| | | | | |
|---|---|---|---|---|
| 6,276,216 | B1 | 8/2001 | Bittenbinder et al. | |
| 6,299,139 | B1 * | 10/2001 | Kazerooni | 254/270 |
| 6,386,513 | B1 * | 5/2002 | Kazerooni | 254/270 |
| 6,554,252 | B1 * | 4/2003 | Kazerooni et al. | 254/270 |

FOREIGN PATENT DOCUMENTS

| | | | |
|---|---|---|---|
| GB | 2156763 | A * | 10/1985 |
| JP | 404323196 | A * | 11/1992 |

* cited by examiner

ACTUATOR

This application claims priority to the Provisional Patent Application No. 60/333,610 submitted Nov. 27, 2001 by Christopher J. Morse, Benjamin T. Krupp, Jerry E. Pratt and Aaron G. Flores using U.S. Express Mail No. ET402315547US, which is hereby incorporated by reference in its entirety.

FIELD OF THE INVENTION

The present invention is directed generally to an actuator. Specifically, the present invention is directed to a hoist that is responsive to force inputs.

BACKGROUND OF THE INVENTION

A traditional hoist consists of a motor connected to a spool, which is used to wind a cable up and down to move a payload vertically. Typically, these devices are remotely controlled with various up/down buttons on a pendant. By attaching the payload to the end of the hoist cable, a human operator can raise and lower heavy payloads by simply pressing the pendant's buttons. This type of hoist can be found in many manufacturing operations requiring movement of payloads that are too heavy for human operators. Though traditional hoists are indispensable for their tremendous load lifting capabilities, their slow, non-variable speeds, and remote controlled operation can be less than ideal for many manufacturing applications.

Consider a simple automotive assembly procedure such as placing an engine block on its engine mounts. During the assembly sequence, the operator raises an engine block from the factory floor, up and over the front fender, into the engine bay and onto the motor mounts. An extremely wide range of speeds would be desirable for this task. While moving from the factory floor to up and over the front fender, it would be desirable to move at quick human-like speeds. Slower speeds would be desired while lowering the engine block into the car's engine bay. Finally, extremely low speeds with regular changes in direction would be most suitable when precisely placing the engine block on the engine mounts. This would be inefficient and frustrating, even with a highly skilled operator using a dual speed hoist. The high speed command would not be fast enough for moving from the factory floor to up and over the fender and the slow speed would not be slow enough for precise placement on the engine blocks.

Poor performance is tolerated in applications requiring super-human strength because there are few alternatives. However, there are countless applications in which a traditional hoist could be used to significantly reduce operator strain (for example placing a 50 pound car seat or 20 pound car battery) but is not used because of the frustration and inefficiency associated with the clumsy and slow operational features of traditional hoists.

SUMMARY OF INVENTION

According to one illustrative embodiment of the invention, there is provided an actuator for providing a force, having a base, a power source, a power transmission element coupled to the power source and constructed and arranged to move a load, and a physically compliant force measurement element constructed and arranged to provide at least partial support between the power transmission element and the base separate from the power source. The force measurement element deflects in relation to the force on the load.

In another embodiment, a hoist is provided, having a baseplate, a power source, a power transmission element coupled to the power source and constructed and arranged to at least partially support a load, and an elastic element that is coupled to the baseplate and supports at least a portion of the power transmission element on the baseplate without the elastic element exerting a substantial force on the power source.

In yet another illustrative embodiment of the invention, there is provided a method of controlling a hoist having a power source. The method comprises measuring the deflection of an elastic element that provides support between a hoist base and a payload without the support passing through the power source, providing a signal to a controller that indicates the deflection measurement, and providing a control signal that actuates the power source in relation to the measurement of the elastic element deflection.

Other features and aspects of the invention will be apparent from the detailed description, the figures, and the claims.

FIGURES

DETAILED DESCRIPTION

Figure 1:
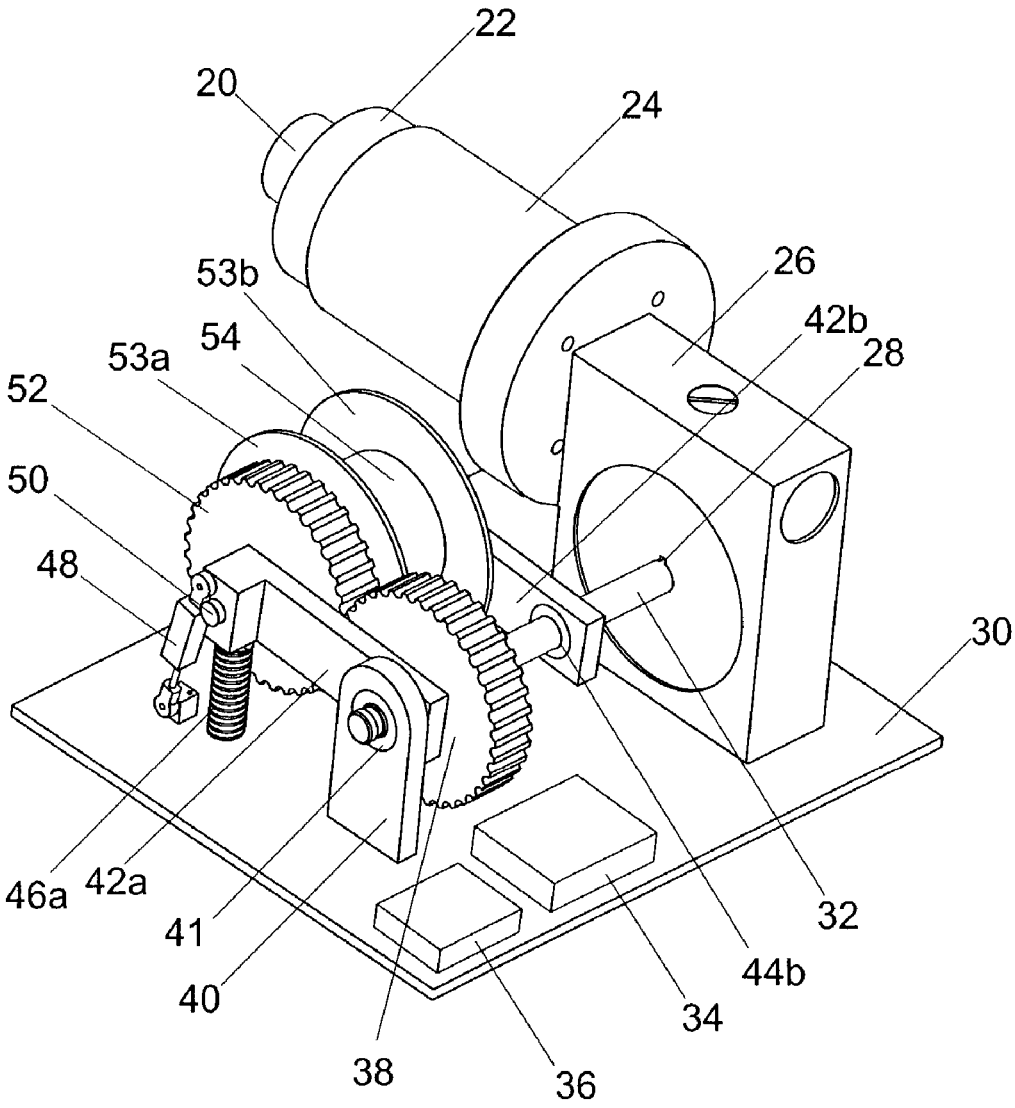
FIG. 1 is a perspective view of a hoist according to one illustrative embodiment of the invention.

It would be desirable to be able to perform tasks such as lifting an engine block or a 50 pound car seat or a 20 pound car battery using a device that counterbalanced the payload weight and could operate over a continuously variable range of speeds. Input commands could flow directly from the user to the load instead of through a remotely controlled pendant. In this way, the operator could firmly grasp a payload such as an engine block with both hands and lift if off the factory floor and up and over the front fender at a natural speed, as if it weighed less than one pound. Once over the engine bay, the engine block could be slowly lowered into position and jostled into place almost effortlessly.

The industry has responded to this type of need with various payload counterbalancing devices, including pneumatic balancers, spring balancers, servomotor controlled balancers, and load cell balancers. The performance of these balancers is measured by their ability to:

(a) manually counterbalance varying payloads. It is desirable for a counterbalancing mechanism to manually accommodate varying payloads easily because payloads can change weight from operation to operation.

(b) automatically counterbalance dynamically varying payloads. Additionally, the ability to automatically adjust to a dynamically varying payload is important when payload weight changes as an assembly process proceeds. To achieve dynamic counterbalancing, the counterbalancing device typically has a force measurement sensor which can sense change in weight.

(c) present the operator with a small 'dead-band'. The balancing dead-band refers to the additional force required to move a counterbalanced payload up or down, thus a large dead-band requires significant operator effort even to move a counterbalanced payload. Large dead-bands are especially detrimental to performance if the dead-band is significant when compared to the payload. For example, a 10 pound dead band (i.e. 10 pounds of operator force) to move a 1000-pound payload may be acceptable, but the same 10-pound dead-band with a 20 pound payload may not be acceptable. Dead-bands are usually the result of static friction in the counter-balancing device.

(d) embody a small physical size. Reduced physical size is desirable in cramped manufacturing facilities. Typically, it is desirable to reduce the vertical dimension of the counterbalancing mechanism because it plays a role in the maximum floor clearance of the payload.

Spring balancers use constant force springs to counterbalance payloads. Spring balancers can manually accommodate payload changes if the operator manually adjusts spring tension. However, the counterbalancing force can be changed by only a small amount.

With traditional spring balancing hoists, it is difficult to dynamically change the counterbalancing force for dynamically varying payloads. With few moving parts, spring balancers inherently have very little friction and thus have very small dead-bands. For relatively small payloads, spring balancers can be designed to be physically compact. Unfortunately, the material properties of spring steel have prevented them from being successfully scaled to meet the need for heavier payloads. Given these performance characteristics, spring balancers are often used for cramped spaces where lightweight payloads change only occasionally. Spring balancers are less suitable for counterbalancing large and dynamically varying payloads.

Pneumatic balancers use air pressure inside pneumatic cylinders to provide counterbalancing force to payloads. Pneumatic balancers can be changed manually (i.e. pressing a button) with clever design of control relays that actuate pressure regulators. With no sensor to measure force, pneumatic balancers typically do not accommodate dynamically changing loads. Because of airtight seals in the pneumatic cylinder, the static friction in pneumatic balancers is high, resulting in a large dead-band. With such a large dead-band, pneumatics are less than desirable for small loads where the dead-band might be a significant percentage of the payload itself. Because each inch of travel adds an inch of length to the pneumatic cylinder, pneumatic balancers have the further problem that they can become cumbersome for large ranges of motions. Given these performance characteristics, pneumatic balancers are suited more for counterbalancing heavy and varying payloads, where sufficient overhead space can accommodate large height requirements. They are not as well suited for counterbalancing light payloads or payloads that require large ranges of vertical motion or vary dynamically.

An alternative to spring balancers and pneumatic balancers is a servomotor controlled balancer. By using a servomotor, the torque of the spool (thus the counterbalancing force on the load) can be accurately controlled using a well-known relation between motor torque and motor current. By turning a knob to control motor current, the user can manually balance varying payloads. With no sensor to measure force, servomotor balancers typically do not accommodate dynamically changing loads. Servomotors typically operate very inefficiently at low speeds and high torques, as is often the case when they are used in hoists. To compensate for poor efficiency, the servomotor would have to be considerably over-sized for use in a counterbalancing hoist, resulting in a cumbersome design. Alternately, a smaller motor could be operated very efficiently at high speeds and low torque. A gear reduction could be used to reduce the speed and increase the torque for this application. The use of a gear reduction may introduce significant friction and increase the reflected inertia at the output of the gearbox. In fact, friction can become essentially infinite in some types of non-backdriveable gear reductions with large reduction factors. Such a design would result in a large, or even infinite, dead-band. Given these performance characteristics, servomotor balancers are more suitable for balancing varying payloads if the size and expense of an oversized servomotor is not a concern. They are less suitable for counterbalancing payloads that vary dynamically.

The final category we discuss is load cell balancers. Wannasuphooprasit, et al. in U.S. Pat. No. 6,241,462 disclose a hoist that has a load cell which allows it to counterbalance dynamically varying payloads. The hoist actively controls the force on the load cell (thus the payload) through a feedback controller, where the actual load force is measured using a load cell and the motor is servoed to correct for differences between the desired load and actual load. This sensing and control scheme is commonly used to control force. With feedback control, small dead-bands are achievable. Since it is unnecessary to use excessively large motors or linearly actuated cylinders, physically compact designs are attainable. Given their performance characteristics, load cell balancers are often suitable for balancing both lightweight and heavy payloads that vary dynamically.

Load cells can be sensitive to shock loads and due to the high mechanical stiffness of load cells, controller gains are often kept relatively low to insure stability of the feedback control loop. Low control gains result in sluggish response times and non-optimized dead-bands. A further drawback is the presence of 'chatter', a phenomenon that is common in load cell systems when in contact with stiff environments.

Pratt et al., in U.S. Pat. No. 5,650,704, entitled "Elastic Actuator For Precise Force Control", the entirety of which is hereby incorporated by reference, disclose a novel actuation scheme, dubbed "Series Elastic Actuation" in which an elastic element is intentionally placed in series between a motor and a load. Pratt et al. recognized that incorporating an elastic element in series with the payload allows the introduction of high control gains (relative to those achievable with load cell force control). As a result of high control gains, low impedance and high force fidelity were achieved. Additionally, the series elastic element provides inherent shock tolerance. Robinson describes these advantages in detail in Robinson, D. W. 'Design and Analysis of Series Elasticity in Closed-loop Actuator Force Control', Ph.D. Thesis, Massachusetts Institute of Technology, 2000, the entirety of which is hereby incorporated by reference.

Although Series Elastic Actuators show a marked improvement in performance as compared to typical force controlled actuators utilizing load cells, there remains a disadvantage: the actuator motion is bounded and typically small. This limitation is due to the need for the elastic element to move with the load. If the movement of the elastic element is linear, then the actuator's motion may be bounded by the stroke length of the actuator. If the movement of the elastic element is rotary, then the actuator's motion may be limited by sensor wires that measure force in the elastic element. In such an arrangement, the amount of rotation may be limited as the sensor wires may become overly twisted. In many applications, a limited motion is acceptable. For example, a joint in a robot arm or leg requires limited actuator motion since the joint can only rotate a fraction of a turn. In other applications, such as hoists and cranes, large motion may be required, and therefore Series Elastic Actuators, as disclosed in U.S. Pat. No. 5,650,704 may not be entirely suitable.

According to various embodiments disclosed herein, an actuator is presented for aiding in the lifting or moving of loads. In one embodiment, a spring-loaded counterbalancing hoist with improved dead-band and shock tolerance allows an operator to move a payload while the hoist dynamically counterbalances the payload weight. In some embodiments, a compliant element (e.g., a compression spring, a torsional spring, a rubber element, etc.) is combined with a position transducer (e.g., a potentiometer, a strain gauge, an optical encoder, etc.) to measure the force of the payload. Higher control gains, as compared to force control algorithms using load cells, allow gear reduction friction and motor inertia to be masked to a greater degree. Masked friction and inertia can result in a further reduction of the dead-band. In some embodiments, an actuator has a power source and a power transmission element and the compliant element at least partially supports the power transmission element. For purposes herein, a power transmission element can comprise some or all of the elements that transmit power from the power source output to the load. The power transmission element may include drive transmission assemblies, armature assemblies, gearboxes, pulleys, idle pulleys, cables, etc. Several aspects of various embodiments of the present invention with relation to conventional counterbalancing devices include:

(a) The option to manually change the counterbalancing force to accommodate varying payloads. The counterbalancing force can be continuously variable (as opposed to discrete changes of pneumatic counterbalances) and can be realized with the push of a button (as opposed to spring balancers).

(b) The ability of the device to automatically change the counterbalancing force dynamically to accommodate varying payloads. Because spring, pneumatic and servomotor balancers do not have force-sensing elements, they do not have this ability. Compared to load cell balancers, a force-sensing elastic element is inexpensive and robust to shock loads.

(c) A small dead-band. An improvement in the dead-band, as compared to spring, pneumatic, and servomotor balancers, can be achieved with closed-loop feedback. High control gains, realizable with the use of an elastic element for force sensing may provide a better dead-band is than a load cell balancer.

(d) physically compact design realized with small motors and large gear reductions, feasible because of the use of an elastic element for force sensing.

(e) inherent shock tolerance due to the elastic element.

Figure 2:
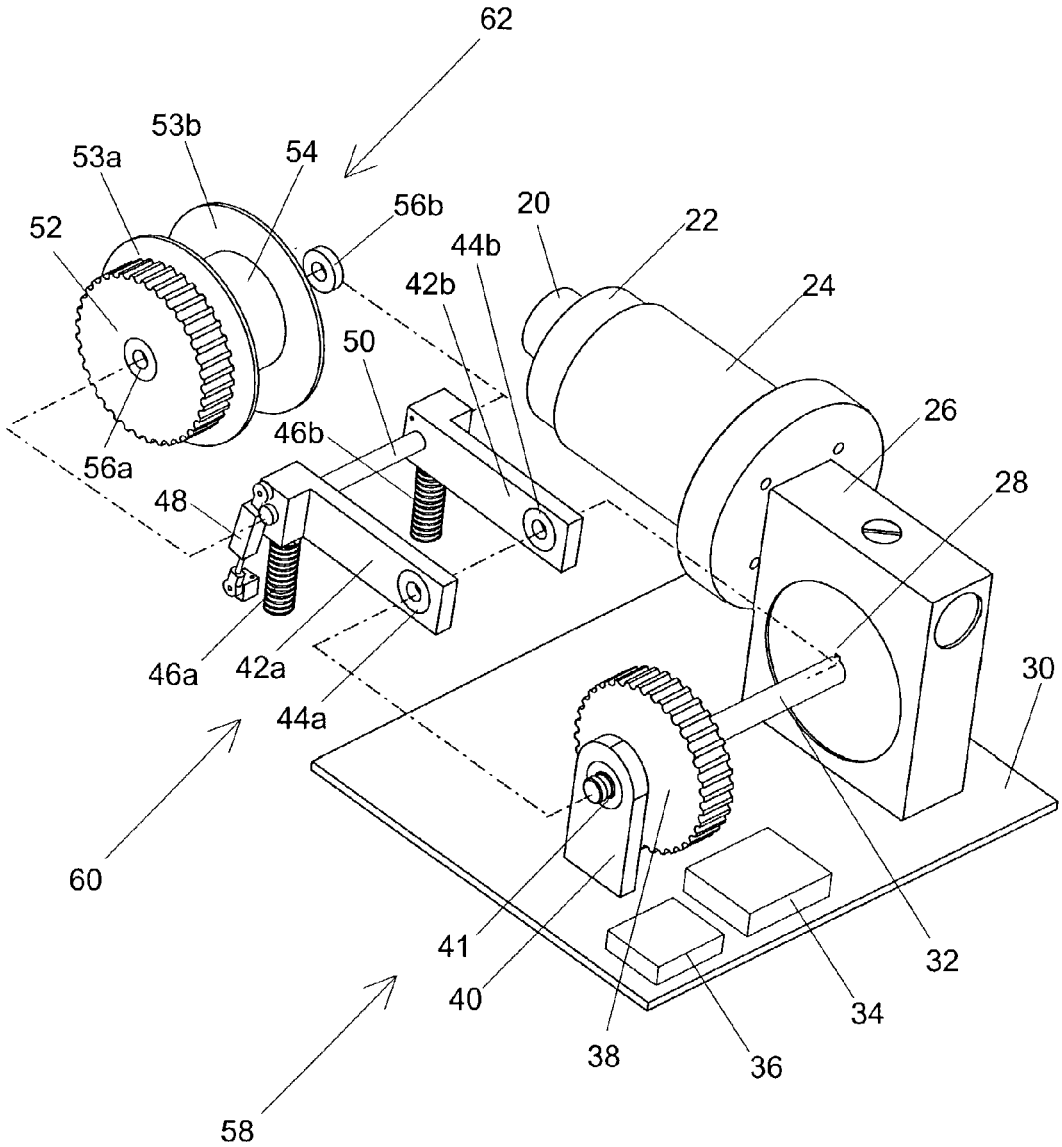
FIG. 2 shows a drive train subassembly, an armature subassembly, and a spool subassembly in an exploded view.

FIG. 1 is a perspective view of a spring-loaded counterbalancing hoist according to one illustrative embodiment of the invention. FIG. 2 shows a partially exploded view of the hoist shown in FIG. 1 with a drive train subassembly 58, an armature subassembly 60 and a spool subassembly 62. The drive train subassembly 58 includes a shaft encoder 20, a brake 22 and a servomotor 24 concentrically aligned and affixed to one another. The mechanical output of servomotor 24 is coupled to the input of a gear reduction 26. A drive shaft 32 is coupled to the output of gear reduction 26 by a keyway 28. The drive shaft 32 is simply supported at its far end by a drive shaft support bearing 41, which is mounted in a bearing housing 40. A drive gear 38 is mounted on drive shaft 32 near bearing housing 40. Gear reduction 26 and bearing housing 40 are mounted on a base, such as baseplate 30. Other types of bases are contemplated, for example, a chassis, a robot link, and so on. A motor amplifier 34 and a controller 36 are also mounted on baseplate 30. The armature subassembly 60, shown in FIG. 2, includes a left armature 42*a* and a right armature 42*b* located on each side of the drive gear 38. A left armature bearing 44*a* and right armature bearing 44*b* are mounted in left armature 42*a* and right armature 42*b*, respectively. A spool shaft 50 connects armatures 42*a* and 42*b* to one another. A left compression spring 46*a* and a right compression spring 46*b* are affixed to armatures 42*a* and 42*b*, respectively. The free ends of compression springs 46*a* and 46*b* rest on baseplate 30. For purposes herein, "connected to" or "coupled to" do not require that two elements be physically attached. For example, compression springs 46*a* and 46*b* are connected and coupled to baseplate 30 even though the free ends of the springs may rest on baseplate 30. A position transducer, such as a potentiometer 48, is connected between left armature 42*a* and baseplate 30. Of course, other types of position transducers may be employed, such as strain gauges, conventional hall effect sensors, magnetic position transducers, and optical position transducers, among others. Finally, the spool subassembly 62, shown in FIG. 2, includes a spool gear 52 which meshes with drive gear 38 and spins freely on spool shaft 50 by way of a left spool bearing 56*a*. A second spool bearing 56*b* is mounted concentrically in a spool 54. Spool 54, a left spool flange 53*a* and a right spool flange 53*b* are affixed concentrically to spool gear 52.

Other compliant elements may be used in place of compressions springs 46*a* and 46*b*. For example, torsional springs or rubber elements may be used. The compliant elements may be constructed of various suitable materials, for example, steel, aluminum, delrin, or nylon. In some embodiments, one compliant element along may be used. In other embodiments, two or more compliant elements may be used. If compression springs are used, such as in the embodiment shown in FIG. 1, each spring may have different properties. For example, compression spring 46*a* may be stiffer than compression spring 46*b*.

Figure 3:
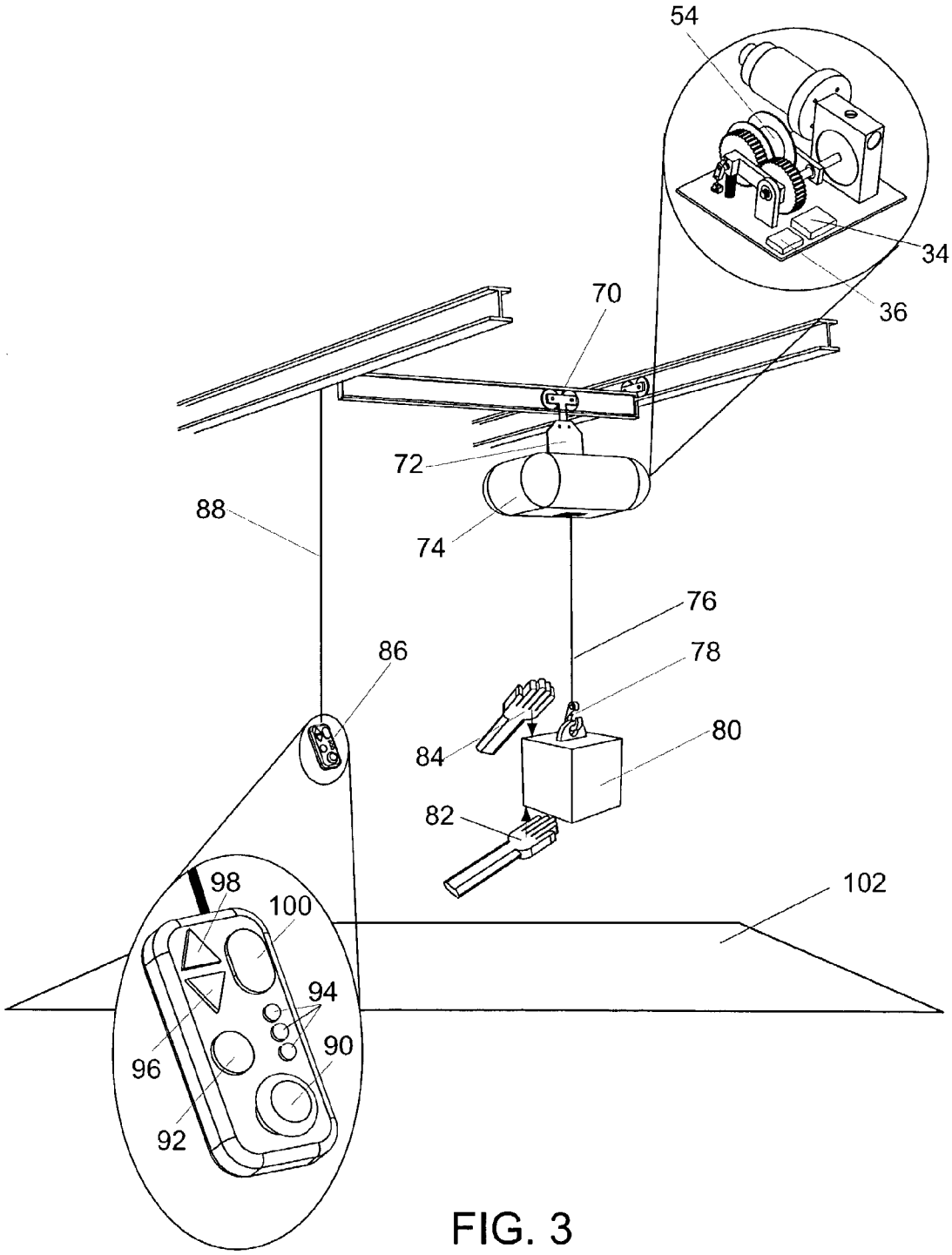
FIG. 3 shows an example operational setup for a hoist.

FIG. 3 shows a typical mounting arrangement for the hoist. The hoist is enclosed in a hoist housing 74. A mounting plate 72 protrudes from the top of the hoist housing 74 and is attached to a moveable overhead carriage 70. A payload 80 is attached to a payload hook 78 at the end of payload cable 76 which is helically wound and terminated on spool 54. A control pendant 86 is in communication with the controller 36 and the motor amplifier 34 via a communication cable 88. The control pendant 86 includes an on/off button 90, a float button 92, an array of system status LEDs 94, a down button 96, and up button 98, and a fast button 100.

OPERATION

Operational Description—FIG. 3 shows an operational setup for the hoist according to one illustrative embodiment of the invention. Overhead carriage 70 allows the operator to move the hoist in two directions above the workspace 102. Payload 80 is attached to the hoist via payload hook 78. The operator commands the hoist to move payload 80 up and down in the vertical direction. In this embodiment, the operator has two modes of operation to choose from: float mode or manual up/down mode. Float mode is selected by depressing float button 92 on pendant 86. In float mode, the weight of payload 80 is actively counterbalanced by the hoist with a closed-loop feedback control algorithm described below. Thus, the operator can apply an upward force 82 or a downward force 84 directly to payload 80 to move it in the desired vertical direction. The forces 82 and 84 may be small compared to the weight of a large load, allowing the operator to move the load easily and intuitively while expending less energy. Alternately, the operator may choose to operate in manual up/down mode. In manual up/down mode, the hoist performs like a traditional hoist. The operator issues velocity commands remotely from a control pendant 86. If the user pushes up button 98, the hoist will move the load upward at a moderate speed. If the user pushes down button 96, the hoist will move the load downward at a moderate speed. If the fast button 100 is pressed while the up button 98 or down button 96 is also pressed, the hoist will move the load 80 up or down at a faster speed.

Mechanical Operation—Referring to FIG. 1, the following describes the motion of parts as the hoist is operated to lift a load. In lifting a load, servomotor 24 powers the gear reduction 26 causing the drive shaft 32 and attached drive gear 38 to rotate. Drive gear 38 meshes with spool gear 52, thereby rotating spool 54. Depending on the rotational direction of servomotor 24, spool 54 winds or unwinds payload cable 76 (see FIG. 3) and hence lowers or raises payload 80. Brake 22 can be used to lock servomotor 24 in place, thereby preventing payload 80 from moving, except for small motions afforded by the compression of springs 46*a* and 46*b*. Upon power-up the brake 22 is initially engaged. The brake 22 remains engaged until the operator issues a command via the control pendant 86. Upon power down or power failure, the brake engages automatically via a spring-loaded mechanism to prevent the load from falling. A watchdog timer circuit may also be employed to lock the brake 22 in cases of controller 36 failure.

While the hoist shown in FIG. 1 is described in connection with lifting and lowering loads, the components may be arranged to push and/or pull on objects. For example, the actuator in the hoist may be configured to power a robotic joint.

Figure 4:
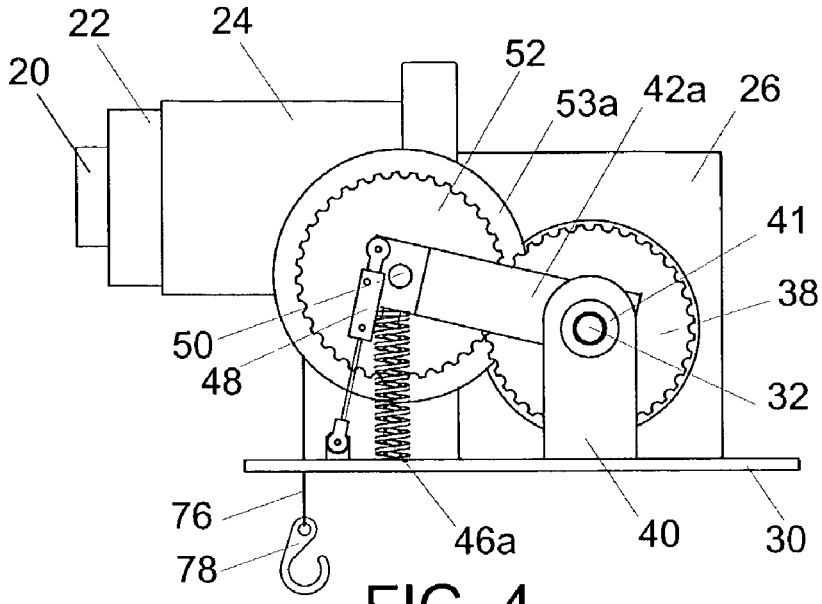
FIG. 4 shows a side view of a hoist in an unloaded configuration according to an illustrative embodiment of the invention.
Figure 5:
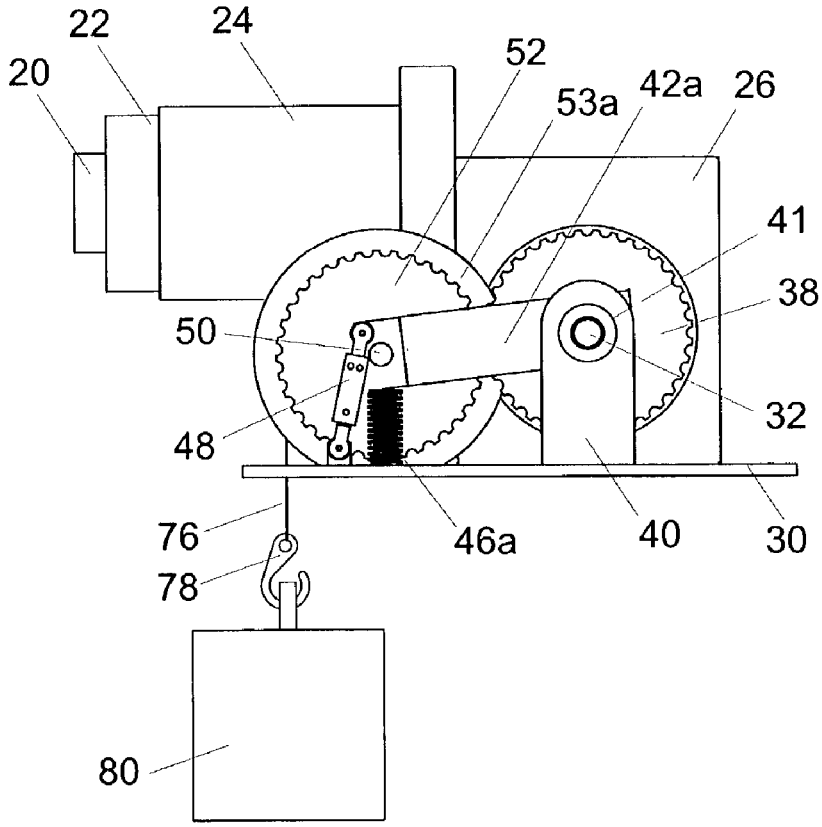
FIG. 5 shows a side view of the hoist shown in FIG. 4 in a fully loaded configuration.

FIG. 4 shows a side view of the hoist in an unloaded configuration according to one illustrative embodiment. FIG. 5 shows a side view of the hoist in a fully loaded configuration, with the load supported on baseplate 30 by compression spring 46. A load, or other element, is considered "supported on" or "supported by" the base even if the load or other element is positioned below the base. Together, FIG. 4 and FIG. 5. show how the force on payload 80 can be measured. As the force on payload cable 76 increases, springs 46*a* and 46*b* deflect to counteract a portion of the force. To understand this operation it is instructive to first examine how the springs deflect due to a load when the brake 22 is engaged, thereby fixing drive shaft 32 and drive gear 38. Because spool gear 52 meshes with drive gear 38, the spool gear 52 is unable to rotate freely about spool shaft 50 unless drive gear 38 is also able to rotate. This prevents load 80 from unwinding payload cable 76 freely from spool 54. Still, even when drive gear 38 is locked in place, the armature subassembly 60 and spool subassembly 62 remain free to rotate with respect to drive gear 38 because of armature bearings 44*a* and 44*b* and the spool bearings 56*a* and 56*b*. Thus, payload 80 produces a downward force on the armature subassembly 60, causing the armature subassembly 60 to rotate CCW around drive shaft 32. Springs 46*a* and 46*b* provide a counterbalancing force stopping the CCW rotation of armature subassembly 60.

Figure 6:
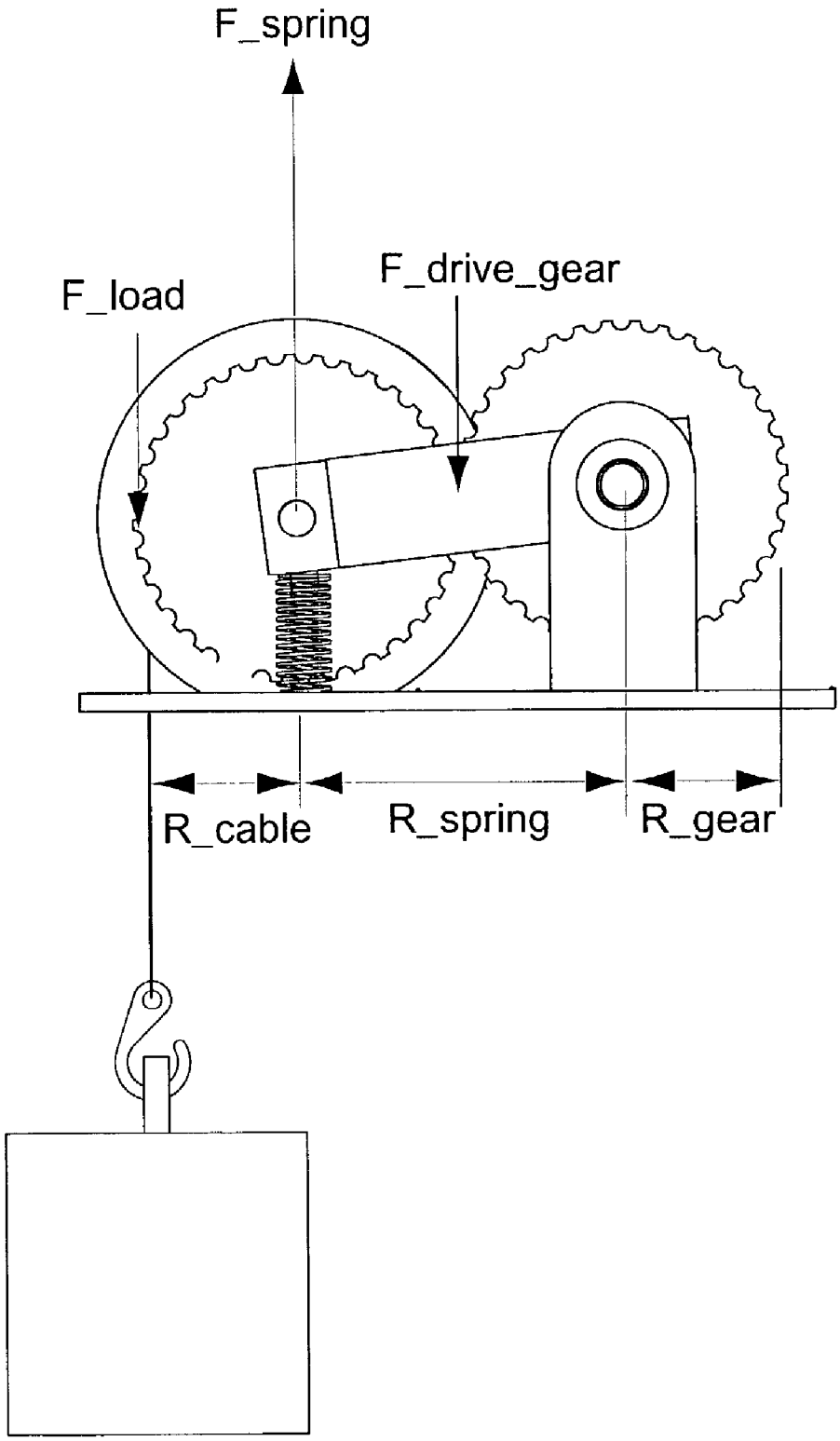
FIG. 6 shows forces acting on a spring element.

The force that springs 46*a* and 46*b* apply to counterbalance the load force can be computed using the free body diagram of FIG. 6. In the following calculations, we assume that the armature and spool subassemblies are in equilibrium such that the forces on the spool 54 sum to zero and the torques about the armature bearings 44*a* and 44*b* sum to zero. This assumption is valid since the mass of the spool subassembly 62 and armature subassembly 60 is small compared to typical loads. We also assume that the forces from the load, springs, and drive gear are all in the vertical direction. This approximation is valid since the angle the armatures 42*a* and 42*b* rotate is typically small. One could relax both of these assumptions to derive similar equations but we keep the assumptions here to avoid confusion.

There are three forces acting on the spool 54. The load applies a downward force of F_load. The spring applies an upward force of F_spring. The drive gear supplies a downward force of F_drive_gear. Applying a force balance, we get $$F_load+F_drive_gear=F_spring. \quad (1)$$

There are three torques acting about armature bearings 44*a* and 44*b*. The load applies a counterclockwise torque of F_load*(R_cable+2*R_gear) where R_cable is the distance from spool shaft 50 to the cable exit point from the spool shaft; R_gear is the radius of the drive gear 38 and spool gear 52. The spring applies a clockwise torque of F_spring*R_spring where R_spring is the distance from the drive shaft 32 to the springs 46*a* and 46*b*. The drive gear applies a counterclockwise torque of F_drive_gear*R_gear. Equating the sum of torques about the armature bearings 44*a* and 44*b* to zero, we get $$F_load*(R_cable+2*R_gear)-F_spring*R_spring+F_drive_gear*R_gear=0 \quad (2)$$

By algebraically manipulating Equations 1 and 2 to eliminate F_drive_gear, we can solve for F_spring as a function of F_load, or F_load as a function of F_spring:

$$F_spring=(R_gear+R_cable)/(R_spring-R_gear)*F_load \quad (3)$$

$$F_load=(R_spring-R_gear)/(R_gear+R_cable)*F_spring \quad (4)$$

The force on the spring can be calculated using Hooke's Law (F=Kx) where K is the known spring constant of compression springs 46*a* and 46*b* and x, the deflection of the spring or springs, is measured with a deflection measurement device, such as a potentiometer 48. For a non-linear spring, a similar relation can be used. F_load can then be computed using Equation 4.

Control System Operation—Referring to the illustrative embodiment shown in FIG. 3, the control pendant 86 sends the operator's commands to controller 36 via the communications cable 88. The controller 36 accepts signals from the control pendant 86, potentiometer 48, and shaft encoder 20, and sends commands to motor amplifier 34, which sends electrical current to servomotor 24.

Figure 7:
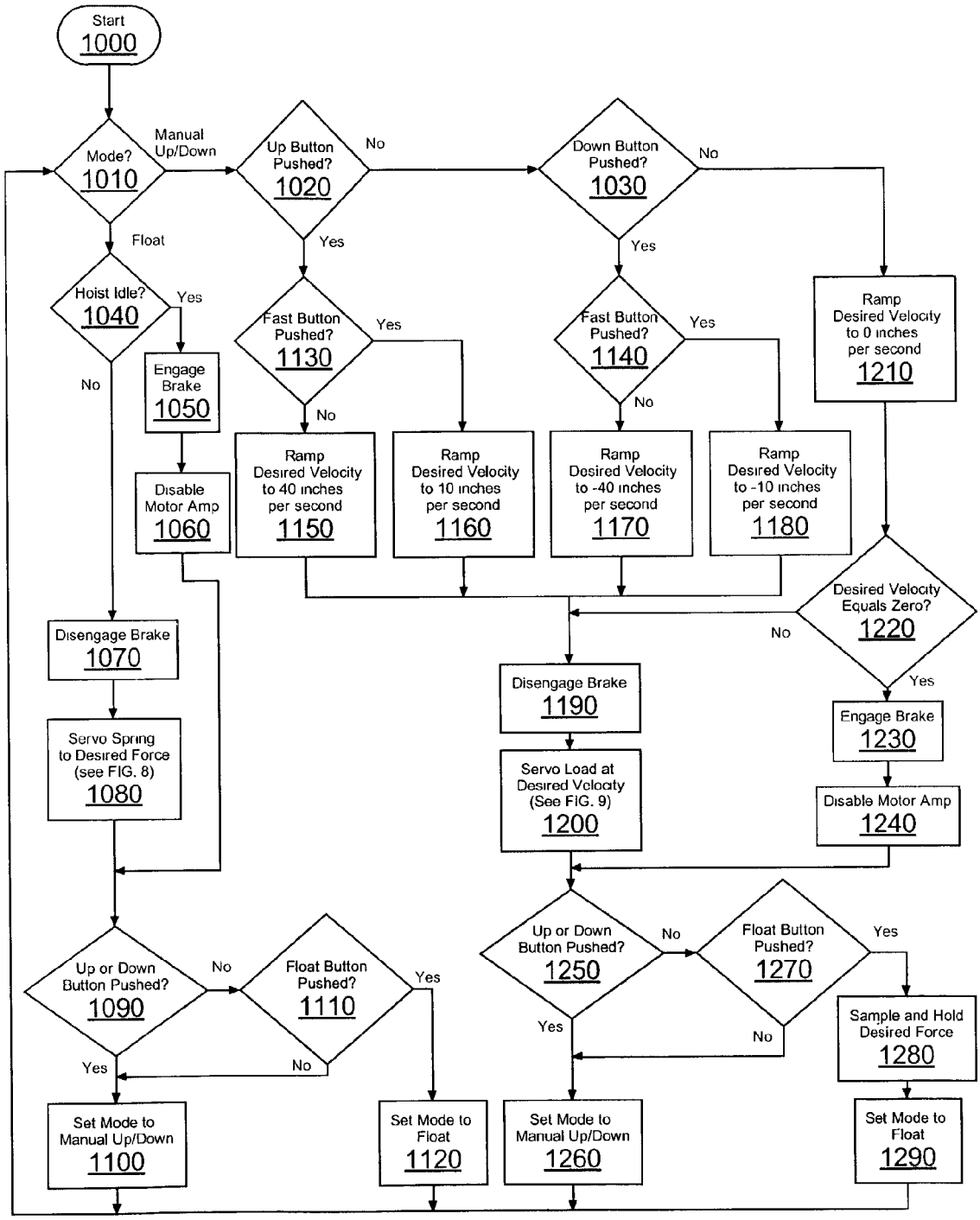
FIG. 7 is a flow chart of an example high-level control algorithm.
Figure 9:
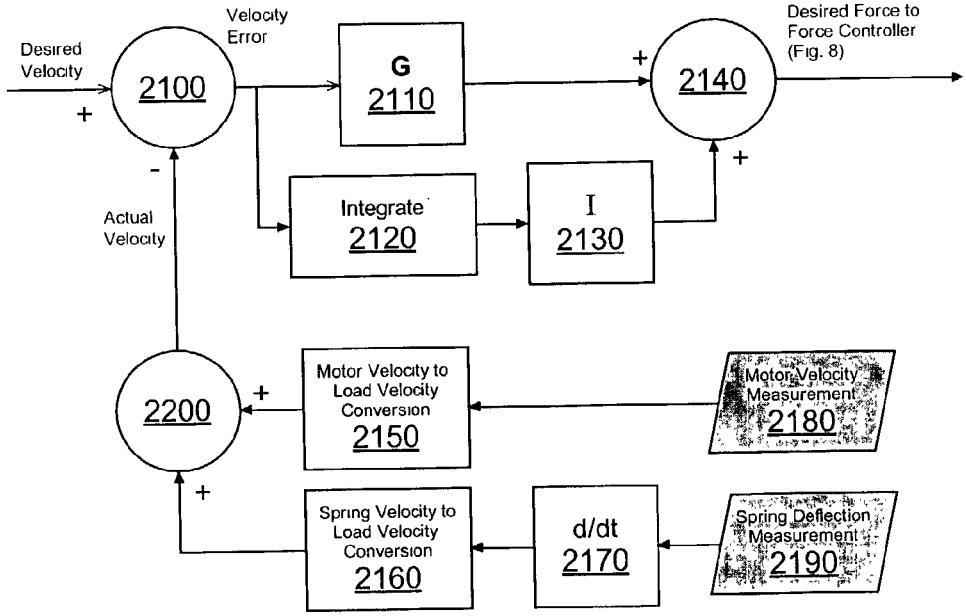
FIG. 9 is a block diagram of an example velocity feedback controller.

FIG. 7 shows a high-level flow chart of one illustrative embodiment of a control algorithm that may be executed by controller 36. This embodiment is presented as an example as many other suitable algorithms may be used. Example values are shown in FIG. 7, but as should be evident to one skilled in the art, any suitable values may be used. On power-up, the algorithm starts at step 1000, sets the desired velocity to zero, engages the brake, disables the motor amp, and sets the mode to manual up/down. Step 1010 is then entered. Since the hoist starts in manual up/down mode, the controller moves to step 1020. If neither the up button or the down button is pushed, then the desired velocity starts ramping to zero in step 1210. Step 1220 checks if the desired velocity is zero and if so, engage the brake in step 1230 and disables the motor amp in step 1240. If the desired velocity is not zero in step 1220, then the brake is disengaged in step 1190 and the load is servoed to the desired velocity in step 1200. (FIG. 9 shows the block diagram for the velocity controller which is explained below.) If either the up button or the down button is pushed, then step 1020 or step 1030 detects it and the desired velocity ramps toward a desired speed in one of steps 1150, 1160, 1170, or 1180, depending on which button was pressed and whether the fast button was pushed (steps 1130 and 1140). After determining the desired velocity, the brake is disengaged in step 1190 and the desired velocity is servoed in step 1200. Whether servoing the desired velocity in step 1200 or disabling the motor amp in step 1240, the controller next enters step 1250 and checks if the up button or down button is pushed. If so, then the mode is set to manual up/down in step 1260 and the controller loops back to step 1010.

Figure 8:
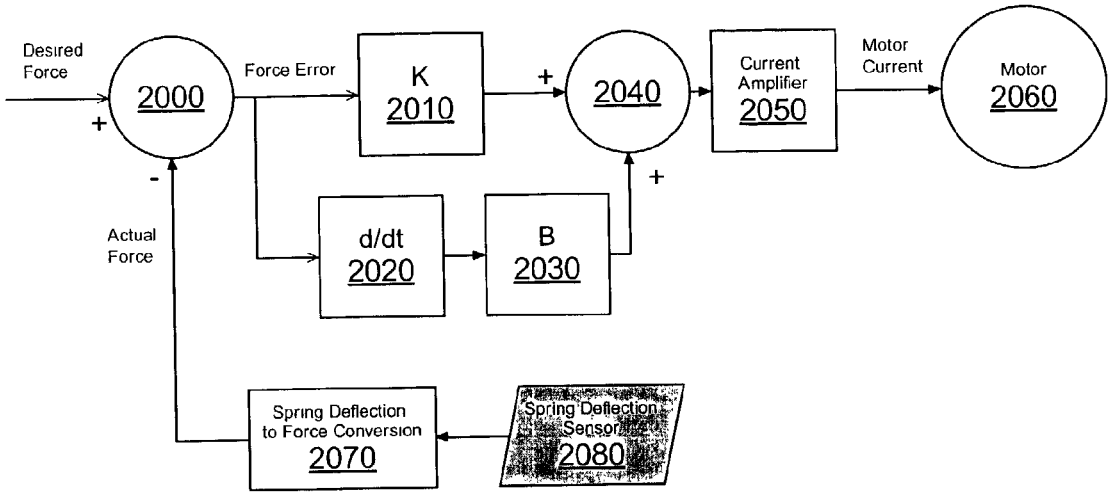
FIG. 8 is a block diagram of an example force feedback controller.

If the up button and down button are not pushed in step 1250, then the controller enters step 1270 and checks if the float button is pushed. If not, then the mode is set to manual up/down in step 1260 and the controller loops back to step 1010. If the float button is pushed in step 1270, then the weight of the load is estimated, sampled, and set as the desired force in step 1280. The controller sets the mode to "float" in step 1290 and loops back to step 1010. In step 1010, if the mode is set to "float", then the controller moves to step 1040 and determines if the hoist is idle (i.e., the load has not moved for a few seconds). If the hoist is idle, then the brake is engaged in step 1050 and the motor amplifier is disabled in step 1060. If the hoist was not idle in step 1040, then the brake is disengaged in step 1070 and the motor is driven in order to compress the spring to the desired force corresponding to the load weight measured in step 1280. (FIG. 8 shows the block diagram for the force controller, which is explained below.) Regardless of whether the hoist is idle, the controller moves to step 1090 from step 1080 or step 1060 and checks if the up button or the down button is pushed. If so, the mode is set to "manual up/down" in step 1100 and the controller loops to step 1010. If not, then the controller moves to step 1110 and checks if the float button is pushed. If the float button is not pushed, the mode is set to manual up/down in step 1100 and the controller loops to step 1010. If the float button is pushed, then the mode is set to "float" in step 1120 and the controller loops to step 1010. Of course, any suitable order of operations or control sequences may be used to control the operation of the actuator or hoist components, and the above flow chart and description is provided by way of example only.

With this control algorithm, to move the payload 80, the operator may first select a mode of operation by depressing the float button 92, the manual up button 98, or the manual down button 96 on the control pendant 86. If the manual up or manual down buttons are pressed, the hoist behaves like a traditional velocity controlled up/down hoist. If the float button is pushed, then the hoist suspends the load by applying an upward force on the load that counteracts gravity. The user can then move the load up or down by manually applying a force to the load that is much smaller than the weight of the load. Thus, the load feels virtually weightless to the operator in float mode.

FIG. 8 shows a block diagram of an example force control servo that may be run in step 1080 of FIG. 7. This force control servo is a standard Proportional-Derivative (PD) control loop that servos to the actual force (i.e., the counterbalancing force) to match the desired force. In block 2080, the spring deflection is measured and converted to the actual spring force in block 2070. This force is subtracted from the desired spring force in block 2000 to get the force error. This error is multiplied by a proportional gain, K, in block 2010 and added to the derivative of the error (block 2020) times a derivative gain, B (block 2030), in block 2040. The resultant signal then goes to motor current amplifier in block 2050, which then drives the servomotor 24. Other method or control algorithms for actuating the power source in relation to the measured spring deflection may be used. For purposes herein, "in relation to" a quantity (such as spring deflection) does not imply in relation to only that quantity. The power source may be actuated, or other actions may be taken, in relation to other inputs or control signals.

Referring to FIG. 1, we illustrate how the controller may interact with the hardware to control the force on the load. If the actual force is greater than the desired force, current is sent to servomotor 24, which causes the drive gear 38 to rotate CW and spool gear 52 to rotate CCW. As a result, spool 54 unwinds cable 76, accelerating load 80 downward, which has the effect of dynamically decreasing the actual force exerted on the compression springs 46*a* and 46*b*. Conversely, if the actual force is less than the desired force, then current is sent to servomotor 24 causing drive gear 38 to rotate CCW and spool gear 52 to rotate CW. As a result, spool 54 winds cable 76, accelerating load 80 upward, which has the effect of dynamically increasing the actual force exerted on the compression springs 46*a* and 46*b*. This is an example of one manner in which the controller can correct for differences between the desired and actual forces on the load.

FIG. 9 shows a block diagram of an example velocity control servo that may be run in step 1200 of FIG. 7. In block 2180, the motor velocity is measured from the shaft encoder on the back of the motor. This measurement is then converted to load velocity in block 2150. In block 2190, the spring deflection is measured and differentiated in block 2170. This signal is then converted to load velocity in block 2160. The measurements from block 2150 and block 2160 are then added in block 2200 to get the actual load velocity. The load velocity is then subtracted from the desired velocity in block 2100 to get the velocity error. The velocity error is multiplied by a gain G in block 2110 and added to the integral of the error (block 2120) times an integral gain (block 2130) in block 2140. The resultant signal is a desired force that is sent to the force controller in FIG. 8, the operation of which is described above. Thus, if there is an error in the velocity of the load, a force will be exerted on the load to correct for the velocity.

Figure 10:
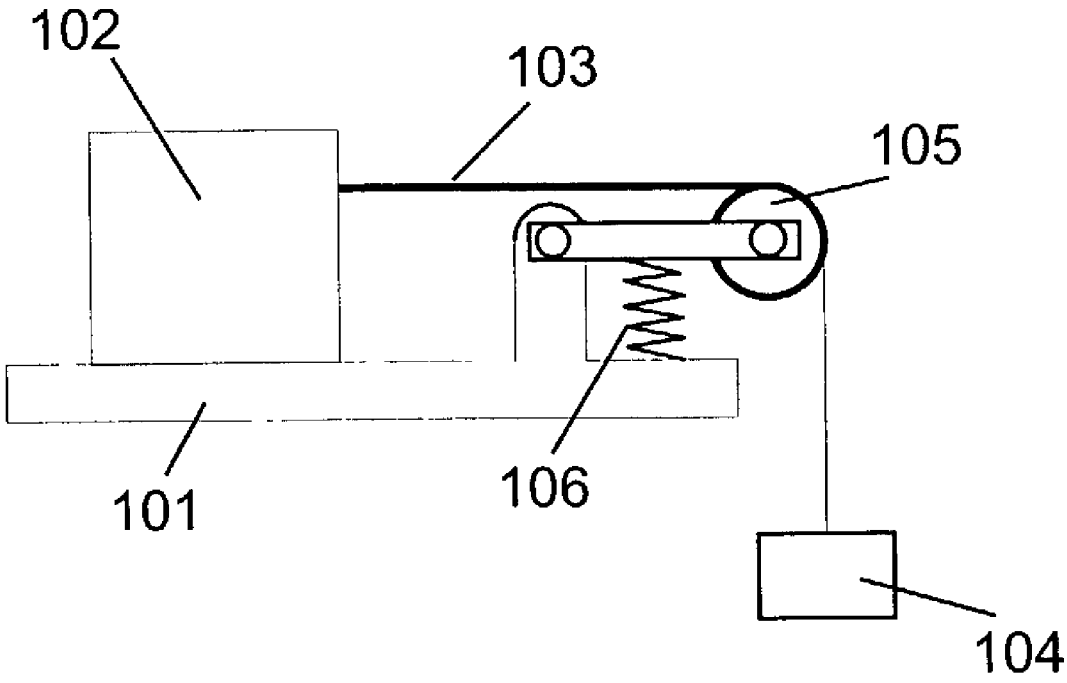
FIG. 10 is a side view of a hoist according to another illustrative embodiment of the invention.

Other embodiments of this invention are envisioned. For example, in another embodiment shown in FIG. 10, a hoist similar to the one shown in FIG. 1 is provided. A power source 102, connected to a base 101, actuates cable 103. Cable 103 winds over idle pulley 105 and then attaches to load 104. Idle pulley 105 is at least partially supported by elastic element 106. The deflection of elastic element 106 relates to the force applied by cable 103 on load 104.

While the above description has been discussed with relation to counterbalancing hoists, various aspects of the embodiments may be used for other applications such as, for example, actuators, hoists, robots, elevators, and industrial machinery.

In view of the wide variety of embodiments to which the principles of the invention can be applied, it should be understood that the illustrated embodiments are exemplary only, and should not be taken as limiting the scope of the present invention. In addition, certain aspects of the present invention can be practiced with software, hardware, or a combination thereof.

We claim:

1. A hoist comprising:

a base;

a motor;

a gear reduction connected at an output of said motor;

a drive shaft connected at an output of said gear reduction;

a drive gear mounted on said drive shaft;

an armature subassembly comprising a left armature and a right armature supported on said drive shaft with a left armature bearing and a right armature bearing;

a spool shaft connecting said left armature and said right armature;

one or more compression springs connected to said base and supporting said spool shaft with a supporting force;

a spool gear which meshes with said drive gear and spins freely on said spool shaft;

a spool fixed concentrically to said spool gear;

a position transducer arranged to measure the deflection of said compression springs;

a payload cable helically wound and terminated on said spool;

a payload attached at the end of said payload cable; and a controller;

wherein the compression springs compress in relation to the force on the payload;

wherein the armature subassembly rotates around the drive shaft in relation to the force on the payload;

wherein the hoist can provide a float mode in which the load feels substantially weightless to an operator physically lifting the load; and the controller provides a control signal to the motor in relation to the deflection of the compression springs as measured by the position transducer and a desired deflection.

2. The hoist of claim 1 wherein the supporting force of the compression springs is related to the force on the payload with the relation F_load=(R_spring−R_gear)/(R_gear+R_cable)*F_spring where F_load is the force on the payload;

F_spring is the supporting force of the compression springs;

R_spring is the distance from the drive shaft to said compression springs;

R_gear is the radius of said drive gear;

R_cable is the distance from said spool shaft to the cable exit point from the spool shaft.

* * * * *